United States Patent [19]

Scobbo

[11] 4,009,310

[45] Feb. 22, 1977

[54] METHOD OF IMPROVING ADHESION OF SECONDARY BACKINGS ON CARPETS

[75] Inventor: James Joseph Scobbo, Stow, Ohio

[73] Assignee: The General Tire & Rubber Company, Akron, Ohio

[22] Filed: July 1, 1976

[21] Appl. No.: 701,840

[52] U.S. Cl. ..... 428/95; 156/72; 156/285; 156/322; 428/97

[51] Int. Cl.[2] ..... D03D 27/00; D04H 11/00

[58] Field of Search ..... 428/85, 94, 95, 96, 428/97; 156/72, 83, 285, 322, 389, 499, 543, 552

[56] References Cited

UNITED STATES PATENTS

| | | | |
|---|---|---|---|
| 3,390,035 | 6/1968 | Sands | 428/95 |
| 3,887,738 | 6/1975 | Taft | 428/95 |

*Primary Examiner*—Marion E. McCamish

[57] ABSTRACT

Wet steam or hot water treatment of a secondary backing just before application to an aqueous adhesive coated back of a carpet or rug such as a tufted carpet containing a primary backing provides on drying and curing of the laminate an increase in many instances in the dry and wet strength of the secondary backing to the primary backing and some reduction in the time of drying or curing of the adhesive to bond the laminate together.

12 Claims, No Drawings

METHOD OF IMPROVING ADHESION OF SECONDARY BACKINGS ON CARPETS

OBJECTS

An object of this invention is to provide improved adhesion between a primary and secondary backing of a rug or carpet such as a tufted carpet.

Another object of this invention is to provide a method for improving the adhesion of a secondary backing to a primary backing or to the back of a rug or carpet, such as a tufted carpet.

These and other objects and advantages of the present invention will become more apparent to those skilled in the art from the following detailed description and working examples.

SUMMARY OF THE INVENTION

A carpet or rug, comprising a plurality of fibers or tufts of fibers woven with a first or primary fibrous backing material, is treated with an aqueous curable adhesive composition which serves to bind those portions of the fibers or tufts woven into the backing to the backing and is then laminated by pressure to a secondary fibrous or woven backing which, prior to lamination to the first or primary backing, has been treated with hot water or wet steam in an amount sufficient to relax the fibers forming the backing and permit the fibers of the backing to protrude into the adhesive and possibly also into the primary backing. The composite laminate is then heated or dried to remove the water and cure the adhesive to bind the ends of the tufts or fibers to the primary backing and to the secondary backing to form an integral laminate exhibiting improved strength in many cases between the primary and secondary backing and to reduce somewhat the overall time of drying and/or curing.

DISCUSSION OF DETAILS AND PREFERRED EMBODIMENTS

While the process of the present invention can be applied to the back of any woven or nonwoven carpet (or rug) material to secure the base yarns to the other yarns of the carpet such as Wilton, Axminster, knitted and other carpets, as well as to a secondary backing, it is particularly useful in the manufacture of piled or tufted carpets. In piled or tufted carpets the fibers or yarn is needled or looped through the interstices or holes in a square woven or nonwoven primary cloth such as cotton, polypropylene, jute or other primary backing material. The primary backing material can be square woven jute although other natural or synthetic fibrous material or mixture thereof can be used. For a thorough discussion of the manufacture or carpets and especially tufted carpets please see "Carpets And Other Textile Floor Coverings," Robinson, 2nd Ed., 1972, Textile Book Service, Division of Bonn Industries Inc., The Trinity Press, London. Please, also, see "Wellington Sears Handbook of Industrial Textiles," Kaswell, 1963, Wellington Sears Co., Inc., New York.

The yarns or tufts of the carpet can be natural or synthetic organic fibers or mixture thereof. Additionally, the yarns may vary from one type to another type. Examples of such yarns are those from silk, cotton, wool, hair, nylon, acrylics (Acrilon), polyester, polyvinyl chloride, vinyl chloride-vinyl acetate copolymers, polyurethanes, rayon, polyacrylonitriles, vinyl chloride or vinylidene chloride copolymerized with acrylonitrile, polyvinylidene chloride, polypropylene fibers and the like. Glass fibers may be blended or woven with the natural and/or synthetic organic fibers. These fibers or yarns can contain fire retardants, antistatic agents, bacteriostats, antidegradants, dyes, pigments, optical brightners, and so forth.

The adhesive used in the practice of the present system is a water based system of polyvinyl acetate, polyacrylates, polyethylene-vinyl acetate copolymers, styrenebutadiene copolymers (SBR), and/or carboxy styrene-butadiene copolymers.

The adhesive preferably used in the practice of the present invention is an aqueous dispersion of a flexible crosslinkable-COOH containing polymer or mixtures of polymers. Examples of such polymers are the copolymers of butadiene, isoprene, 2,3-dimethyl butadiene and other dienes of 4 to 6 carbon atoms with a copolymerizable unsaturated acid such as acrylic acid, methacrylic acid, ethacrylic acid, sorbic acid, maleic acid, fumaric acid, itaconic acid, vinyl benzoic acid, $\alpha$-chloro acrylic acid, crotonic acid, and the like and mixtures thereof. There, also, may be copolymerized with the diene and acid monomer one or more other copolymerizable monomers such as styrene, $\alpha$-methyl styrene, vinyl toluene, acrylonitrile, methacrylonitrile, methylacrylate, ethylacrylate, butyl acrylate, ethyl hexylacrylate, methyl methacrylate, hydroxy ethyl acrylate, hydroxy ethyl methacrylate, acrylamide, methacrylamide, and the like and mixture thereof. Still other polymers can be used such as the copolymers of one or more of the above acrylates and one or more of the above acrylic acids. The addition of the third, fourth, etc. monomer will be determined by the need for compatibility with the carpet materials, stiffness, and the toughness, strength, water and solvent resistance and so forth desired. Preferred copolymers to use are the aqueous emulsions of flexible carboxylated butadiene styrene copolymers, e.g., copolymers of butadiene, styrene and at least one acid selected from the group consisting of acrylic, methacrylic, fumaric, maleic, and itaconic acids. These copolymers may be prepared in aqueous emulsion systems using conventional emulsifiers, chain transfer agents, antioxidants, short-stop agents, free radical catalysts and so forth as well known to the art. Methods for making these polymers are disclosed in U.S. Pat. Nos. 2,604,668; 2,669,550; 2,710,292; 2,724,707; 2,849,426; 2,868,754; 3,392,048; 3,404,116; 3,409,569; and 3,468,833. Please, also, see "Rubber World," September, 1954, pages 784 to 788 and "Industrial And Engineering Chemistry," May, 1955, pages 1006 to 1012. The aqueous adhesive can have a solids content of from about 30 to 60%, have a pH of about 7.5 to 11.5 and have a Brookfield viscosity of about 50–350 (LVF Model No. 2 Spindle at 60 rpm) cps at 25° C.

These carboxylated copolymers are readily crosslinked by means of polyvalent metal compounds such as alkalimetal or ammonium hydroxides, the oxides of zinc, magnesium, cadmium, calcium, titanium, aluminum, barium, strontium, cobalt, tin, iron, lead and others. The chloride, sulfate, nitrate, acetate, and formate salts of Ca, Mg, Ba, Sn, Fe, Sr, Ni, Zn and Co may also be used as crosslinking agents. Metal hydroxides can be used such as the hydroxides of calcium, cadmium, zinc, barium and aluminum. Sodium or alkalimetal aluminate is also a crosslinking agent. Polyamines, also, can be used as crosslinking agents such as ethylene diamine, 1,3-diaminobutane, diethylenetriamine, and the like. Other crosslinking agents can be used such as the epoxides, amino-formaldehyde resins, phenol-formaldehyde resins, ureaformaldehyde resins, urea-melamine resins and so forth. Additionally, sulfur curing systems can be added to the copolymer composition if it contains sulfur curable unsaturation; however, such requires extended curing times at elevated temperatures and may not be too desirable. In fact if a pigment or filler such as limestone, calcium carbonate, is employed, it will furnish sufficient divalent metallic ions during the curing step to provide the necessary crosslinking between the COOH groups of the copolymer. Other divalent metal carbonates may likewise be used. Mixtures of the various curing or crosslinking agents can be used.

In addition to the curing agents the aqueous carboxylated copolymeric adhesive composition can contain the usual antioxidants, dispersing agents, clay, defoamers, $TiO_2$, thickeners, fire retardants, bacteriostats, pigments or colorants, surfactants, alumina, alumina hydrate, U-V absorbers, ammonia cut caesein, and so forth.

The compounded aqueous adhesive composition can contain as high as about 85% total solids content, and its initial viscosity can vary from about 9000 to 20000 cps. It can be used as such or frothed with air or other gas which is nonreactive under spreading and curing conditions to form a foam containing about 20–65% gas.

One example of a useful adhesive for use in the practice of the present invention comprises (1) 200 parts by weight of an aqueous latex of 50% solids of a flexible copolymer of about 50% styrene and the balance a mixture of butadiene-1,3, methacrylic acid and itaconic acid, (2) 400 to 550 parts by weight of ground limestone filler and (3) a minor amount of a polyacrylate thickener such a Paragum 129 (Para-Chem., Inc., Philadelphia). The total solids content of the aqueous adhesive composition is from about 76 to 82% by weight and has an initial viscosity of up to about 20000 cps. This adhesive can be used as such or can be frothed with air or other inert or nonreactive gas for the reaction to contain from about 20 to 65% air. Water can be added to the adhesive to change the viscosity as desired.

The compounded aqueous adhesive coating composition can be applied to the back of the carpet by air knife coating, blade coating, brush-finish coating, cast coating, flow-on coating, knife coating, machine coating, polished drum coating, print on coating, roll coating, spray coating, wire wound rod coating or other methods known to the art for coating the backing of a carpet.

The secondary backing material or layer can be made of any natural or synthetic fibers or mixtures thereof such as cotton, rayon, nylon, polypropylene, acrylics, hair or bast and so forth and is usually made of square woven fibers. Bast fibers include jute, flax, hemp, sunn, ramie, henaf, urena, nettle and the like. Of these backing materials it is preferred to use jute fibers. Please see "Matthews' Textile Fibers," Mauersberger, 6th Edition, John Wiley & Sons, Inc., New York, 1954, pages 257 to 281. Jute fibers are well known commercially, and sources of the same can readily be found in "The Carpet and Rug Institute Directory and Report," 1974–75, September, 1975, published by the Carpet and Rug Institute, Dalton, Georgia. Prior to the use in the practice of the present invention the jute or other backing fiber can be sized with starch, treated with antidegradants, fire retardants and so forth.

Next, the layer of the secondary backing is treated, preferably saturated, with hot or boiling water or wet steam at a temperature and for a time sufficient to relax the fibers of the backing and to increase the amount of fibers protruding from the secondary backing, preferably at a temperature of from about 100° to 200° C., or in other words, it is treated with sufficient fluid $H_2O$ at a temperature up to about 200° C. to obtain the desired adhesion of the secondary jute backing to the back of the carpet and then, while still hot and wet, it is applied or pressed against the back of the carpet which has been coated and impregnated with the adhesive composition described herein.

To review the process, the carpet layer is secured on a tenter (a frame or rack with hooks or clips along two sides use for drying or stretching cloth) or other suitable apparatus and is carried against a roller which coats and impregnates the back of the carpet with the aqueous adhesive composition at ambient temperature. Then a layer of the steamed (second) jute backing is roll pressed against the back of the carpet containing the adhesive layer and held by the tenter frame to prevent separation from the adhesive coated ad impregnated back of the carpet and passed through an air oven at a temperature and for a time sufficient to dry the laminate and cure the adhesive, preferably at about 250°–400° F. for about 1 to 30 minutes, to cause evaporation of the water and curing of the polymer to cause it to adhere or bind the secondary backing to the back of the carpet to form a carpet with a secondary backing integrally bonded to the back of the carpet as well as to bind the fibers of the carpet thereto. If the adhesive is a frothed or foamed adhesive, the pressing of the secondary backing against the back of the carpet causes collapse of the froth and further penetration of the adhesive into the back of the carpet and into the secondary jute backing. The adhesive serves to lock the ends of the tufts or fibers of the carpeting to its cloth or backing and to the secondary backing. As a result of this present process in using a hot $H_2O$ wet or wet steamed ($H_2O$) jute backing instead of a dry jute backing, there has been observed in general an increase in dry adhesion and in wet adhesion of the secondary backing to the back of the carpet, and some decrease in the rate of drying and curing of the assembly of backed carpet, adhesive, and secondary backing as compared to the use of a dry jute secondary backing. There, also, was considerable improvement in the washability of the product of this invention.

The temperature during drying and of the adhesive and secondary backing and crosslinking of the adhesive should be below that which would adversely affect the properties of the tufts or bulk of the fibers of the carpet by causing loss of strength, melting and so forth.

The following examples will serve to illustrate the invention with more particularity to those skilled in the art.

EXAMPLE I

The carpet used in this example was a tufted printed carpet in which the primary backing was of nonwoven polypropylene fibers and in which the tufts were nylon yarns.

Two adhesive compositions were prepared using a blend of aqueous carboxylated latices in which the flexible copolymers contained about 50% styrene and the balance butadiene-1,3, methacrylic acid and itaconic acid. The compositions were as follows:

Composition A:

Latex, 200 parts by weight (about 50% solids). Whiting (finely divided washed chalk) 300 pbw. Thickener (Alcogum 9445, a polyacrylate), 2.8 parts (0.28 pbw dry in $H_2O$). The total solids content of the adhesive was 80%. Water was added as necessary to maintain the solids content.

Composition B:

The same as composition A except that the Alcogum was used in an amount of 2.0 parts (0.2 pbw dry in $H_2O$).

VISCOSITIES

| | | |
|---|---|---|
| Theoretical | Composition A | 12,000 cps |
| | Composition B | 8,000 cps |
| Initial | Composition A | 12,400 cps |
| | Composition B | 8,400 cps |
| 24 Hours Before Stirring | Composition A | 15,200 cps |
| | Composition B | 11,000 cps |
| 24 Hours After Stirring | Composition A | 13,800 cps |
| | Composition B | 10,000 cps |

The back of the carpet was coated with 28 oz/yd² of the adhesive composition, the secondary backing was applied with pressure to the adhesive coating, and the resulting assembly or laminate was cured at 138° C. in an oven. After varying periods of time samples were removed from the oven, cooled and tested for adhesive strength (strength recorded in lbs required to separate the secondary backing from the remainder of the laminate (2 inch strip), dry and after being wet with water).

1. Secondary Jute Fiber Square Woven (7 oz./sq. yd.) Backing (Dry) Pressure Applied To Adhesive Coated Back Of Carpet

| | 6 min. cure | | 9 min. cure | | 12 min. cure | | 15 min. cure | | 30 min. cure | |
|---|---|---|---|---|---|---|---|---|---|---|
| Comp. | Dry | Wet | Dry | Wet | Dry | Wet | Dry | Wet | Dry | Wet |
| A | 7.9 | .93 | 7.8 | 1.5 | 7.1 | 2.0 | 8.5 | 1.9 | 10. | 2.2 |
| B | 6.9 | 1.0 | 5.9 | 1.4 | 8.1 | 1.3 | 9.4 | 2.1 | 9. | 3. |
| Av. | 7.4 | 1 | 6.9 | 1.5 | 7.6 | 1.7 | 9.0 | 2.0 | 9.5 | 2.6 |

2. Secondary Jute Fiber Square Woven (7 oz./sq. yd.) Backing Steamed For 4 Minutes Before Pressure Applying To Adhesive Coated Back of Carpet

| | 6 min. cure | | 9 min. cure | | 12 min. cure | | 15 min. cure | | 30 min. cure | |
|---|---|---|---|---|---|---|---|---|---|---|
| Comp. | Dry | Wet | Dry | Wet | Dry | Wet | Dry | Wet | Dry | Wet |
| A | 8.7 | 3.3 | 9.6 | 2.6 | 12. | 2.2 | 11.3 | 3.8 | 11.7 | 3.7 |
| B | 7.5 | 2.0 | 9.0 | 3.8 | 12. | 2.7 | 11.3 | 3.6 | 12.2 | 5.1 |
| Av. | 8.1 | 2.7 | 9.3 | 3.2 | 12. | 2.5 | 11.3 | 3.7 | 12.0 | 4.4 |
| % Av. Improvement of 2. over 1. | 9. | 170 | 35. | 113. | 58. | 47. | 26. | 85. | 26. | 70. |

3. Secondary Backing Square Woven Polypropylene Fiber Interwoven With Cotton and Jute Fibers Steamed For 4 Minutes Before Pressure Applying To Adhesive Coated Back Of Carpet

| | 6 min. cure | | 9 min. cure | | 12 min. cure | | 15 min. cure | | 30 min. cure | |
|---|---|---|---|---|---|---|---|---|---|---|
| Comp. | Dry | Wet | Dry | Wet | Dry | Wet | Dry | Wet | Dry | Wet |
| A | 7.6 | 5.8 | 6.6 | 4.1 | 7.2 | 6.2 | 7.4 | 5.4 | 6.0 | 5.9 |
| B | 6.7 | 5.3 | 6.4 | 3.7 | 5.8 | 4.2 | 7.0 | 4.6 | 8.9 | 5.0 |
| Av. | 7.2 | 5.6 | 6.5 | 3.9 | 6.5 | 5.2 | 7.2 | 5.0 | 7.5 | 5.5 |
| % Av. Improvement of 3. over 1. | −3. | 460. | −6. | 160. | −17. | 206. | −25. | 150 | −27. | 112. |

4. Dry Rates At Temp. Of 138° C., Time In Minutes, Values Recorded As % $H_2O$ Loss Of Laminate During Curing Process

| Above Samples | 1 | 2 | 3 | 4 | 5 | 6 | 7 | 8 | 9 | 10 | 12 | 14 | 15 |
|---|---|---|---|---|---|---|---|---|---|---|---|---|---|
| 1A | 26 | 42 | 60 | 71 | 85 | 87 | 88 | 92 | 94 | 96 | 97 | 98 | 100 |
| 1B | 19 | 44 | 63 | 83 | 92 | 96 | 99 | 99 | 99 | 99 | 99 | 99 | 100 |
| 2A | 20 | 41 | 58 | 73 | 86 | 92 | 97 | 97 | 99 | 99 | 100 | 100 | 100 |

-continued

4. Dry Rates At Temp. Of 138° C., Time In Minutes, Values Recorded As % $H_2O$ Loss Of Laminate During Curing Process

| Above Samples | 1 | 2 | 3 | 4 | 5 | 6 | 7 | 8 | 9 | 10 | 12 | 14 | 15 |
|---|---|---|---|---|---|---|---|---|---|---|---|---|---|
| 2B | 20 | 38 | 56 | 72 | 83 | 89 | 92 | 94 | 96 | 98 | 100 | 100 | 100 |
| 3A | 20 | 45 | 65 | 72 | 84 | 90 | 94 | 96 | 97 | 97 | 99 | 100 | 100 |
| 3B | 18 | 40 | 60 | 72 | 87 | 91 | 94 | 96 | 97 | 97 | 99 | 100 | 100 |

EXAMPLE II

The carpet (brown) used in the example was a 26 oz./sq. yd. tufted nylon 10th gauge continuous filament level loop yarn needled through a square woven polypropylene primary backing. The latices used in the adhesive were two different carboxylated latices containing a flexible copolymer of about 50% styrene and the balance butadiene-1,3, methacrylic acid and itaconic acid, about 50% solids content.

The following adhesive compounds were then prepared:

| Sample No. | Latex pbw | Finely Divided Georgia Marble, $CaCO_3$, No. 9NCS, pbw | GRT-238 Surfactant, Sulfonate Frothing Agent, pbw | Thickener, Paragum No. 154, pbw (Polyacrylate) Dry | Wet | Adhesive Compound Total Solids Content, %, Adjusted with $H_2O$, pbw | RVT No. 5 at 20, Initial Viscosity |
|---|---|---|---|---|---|---|---|
| A | 200 | 400 | 0.5 | .97 | 9.70 | 76. | 12,600 |
| B | 200 | 400 | 0.5 | .47 | 4.70 | 76. | 12,000 |
| C | 200 | 400 | 0.5 | 1.09 | 10.93 | 76. | 16,100 |
| D | 200 | 400 | 0.5 | .59 | 5.87 | 76. | 16,200 |
| E | 200 | 400 | 0.5 | 1.26 | 12.60 | 76. | 19,700 |
| F | 200 | 400 | 0.5 | 0.7 | 6.97 | 76. | 19,800 |
| G | 200 | 400 | 0.5 | 0.3 | 3.0 | 82. | 11,700 |
| H | 200 | 400 | 0.5 | .19 | 1.90 | 82. | 12,800 |
| I | 200 | 400 | 0.5 | .41 | 4.1 | 82. | 16,600 |
| J | 200 | 400 | 0.5 | .24 | 2.37 | 82. | 16,700 |
| K | 200 | 400 | 0.5 | .49 | 4.93 | 82. | 20,000 |
| L | 200 | 400 | 0.5 | .29 | 2.87 | 82. | 20,3000 |

| Sample No. | 24-Hr. Visc. B-H Stir | 24-Hr. Visc. After Stir | Viscosity % Rise | 8 oz. Measuring Cup, pbw.g., Compound | Time Froth Comp. To 40–45% Air | Actual % Air in Comp. |
|---|---|---|---|---|---|---|
| A | 13,000 | 11,600 | 3% | 420 | 3:00′ | 44% |
| B | 11,500 | 11,600 | 4% | 388 | 2:00′ | 48% |
| C | 16,500 | 14,500 | 3% | 414 | 3:00′ | 42% |
| D | 17,100 | 16,000 | 6% | 395 | 1:30′ | 39% |
| E | 21,500 | 18,200 | 9% | 420 | 3:00′ | 44% |
| F | 22,000 | 20,500 | 11% | 408 | 2:00′ | 45% |
| G | 15,700 | 13,100 | 34% | 447 | 2:30′ | 44% |
| H | 13,800 | 13,700 | 8% | 442 | 2:00′ | 42% |
| I | 22,000 | 18,200 | 33% | 440 | 2:00′ | 41% |
| J | 17,800 | 17,200 | 7% | 441 | 2:00′ | 40% |
| K | 25,000 | 23,000 | 25% | 434 | 2:00′ | 40% |
| L | 22,000 | 21,000 | 8% | 435 | 2:00′ | 38% |

The frothed adhesive composition was applied to the back of the carpet at 28 oz. per square yard. Unsteamed and steamed square woven jute was used as the secondary backing and pressed against the adhesive coated back of the carpet. After this lamination, the carpet ultimate adhesions were rated in pounds per 2 inch strip required to separate the secondary backing from the back of the carpet or remainder of the cured laminate, dry and after being wet with water. Before testing the laminate was dried and cured in an oven at the times shown at a temperature of 138° C. For the washability test the laminates were prepared in the same fashion.

In steaming the secondary jute backing the side of the jute for application to the back of the adhesive coated carpet was placed down on a No. 2 mesh screen. A steam line from a laboratory hood was placed about 3 inches below the jute. The steam was blown through the jute for 10 seconds immediately prior to pressing the secondary jute backing against the adhesive coated back of the carpet.

The washability test is run as soon as possible after the laminate leaves the oven. Samples of the laminate are cut into about 7 inch × 7 inch squares (cut inside 8 inch × 8 inch coated laminated area to be sure that all edges of the secondary jute backing are adhering to the back of the carpet). The samples were then washed in a regular washing machine using a detergent using a regular wash, 12 minutes cycle, warm wash plus rinse. The % adhesion after washing is based on 49 sq. in. sample measured in inches square adhering after washing, multiplied by 2 (lbs. per 2 inch strip). The figure 100 in the column indicates that the secondary backing completely adhered to the back of the carpet; the figure 0 indicates that the backing completely separated from the carpet; and the intermediate figures indicate the percent of adhesion of the secondary backing to the carpet.

The results of the tests are shown below:

TABLE I

Normal Secondary Jute Fiber Square Woven (7 oz. sq. yd.) Backing (Dry) Applied To Adhesive Coated Back Of Carpet, Pounds Per 2" Strip, Adhesion; And Washability. Carpet Ultimates.

| Sample | Adhesions | | | | Washability | |
|---|---|---|---|---|---|---|
| | 9 Min. Cure | | 14 Min. Cure | | | |
| No. | dry | Wet | Dry | Wet | 9 Min. Cure | 14 Min. Cure |
| A | 6.7 | 2.2 | 5.7 | 3.6 | 0 | 0 |
| B | 3.6 | 0.61 | 2.7 | 1.5 | 0 | 0 |
| C | 7.1 | 2.8 | 7.2 | 3.5 | 0 | 72 |
| D | 2.4 | 1.1 | 3.8 | 1.8 | 4 | 72 |
| E | 4.7 | 2.7 | 6.8 | 2.5 | 0 | 28 |
| F | 2.2 | 1.4 | 3.5 | 1.7 | 0 | 28 |
| G | 6.2 | 2.5 | 8.2 | 2.5 | 0 | 0 |
| H | 2.4 | 0.57 | 2.3 | 0.90 | 0 | 0 |
| I | 6.4 | 2.1 | 7.4 | 2.6 | 0 | 0 |
| J | 2.1 | 1.4 | 0.96 | 0.69 | 0 | 0 |
| K | 7.4 | 2.4 | 8.1 | 2.8 | 0 | 66 |
| L | 1.6 | 0.37 | 2.4 | 0.87 | 0 | 58 |
| Average | 4.4 | 1.68 | 4.9 | 2.1 | .3 | 27. |

TABLE II

Normal Secondary Jute Fiber Square Woven (7 oz. sq. yd.) Backing (Steamed) Applied To Adhesive Coated Back Of Carpet, Pounds Per 2" Strip, Adhesion; And Washability. Carpet Ultimates.

| Sample | Adhesions | | | | Washability | |
|---|---|---|---|---|---|---|
| | 9 Min. Cure | | 14 Min. Cure | | | |
| No. | Dry | Wet | Dry | Wet | 9 Min. Cure | 14 Min. Cure |
| A | 6.3 | 2.0 | 6.8 | 3.0 | 0 | 100 |
| B | 4.1 | 2.6 | 6.0 | 2.7 | 0 | 72 |
| C | 5.2 | 1.7 | 7.9 | 2.8 | 0 | 100 |
| D | 6.3 | 2.3 | 6.7 | 3.1 | 30 | 100 |
| E | 6.8 | 1.8 | 7.6 | 2.9 | 0 | 100 |
| F | 5.8 | 2.4 | 6.5 | 2.8 | 0 | 58 |
| G | 6.8 | 2.7 | 6.8 | 3.3 | 72 | 86 |
| H | 7.1 | 2.5 | 6.1 | 2.8 | 100 | 100 |
| I | 7.6 | 2.2 | 7.2 | 3.2 | 30 | 100 |
| J | 7.0 | 2.0 | 8.0 | 4.0 | 100 | 100 |
| K | 6.6 | 2.8 | 7.7 | 2.5 | 86 | 100 |
| L | 6.7 | 2.0 | 9.3 | 3.1 | 58 | 100 |
| Av. | 6.3 | 2.2 | 7.2 | 3.0 | 40. | 93 |
| % Improvement Av., Table II Over Table I | 45. | 30. | 47. | 33. | 33. | 44. |

EXAMPLE III

The method of this example was the same as that of Example II, above, except that the carpet was a green shag nylon carpet with a woven cloth polyproplyene primary backing-7 per inch stitch. The adhesive coating was applied at 20 oz. per square yard.

| Adhesive Compound | Dry Jute Backing, Carpet Ultimates, | | | | Steamed Jute Backing, Carpet Ultimates, | | | |
|---|---|---|---|---|---|---|---|---|
| | Adhesion In Pounds, Dry | | Washability | | Adhesion In Pounds, Dry | | Washability | |
| Sample No. | 9 Min. Cure | 14 Min. Cure | 9 Min. Cure | 14 Min. Cure | 9 Min. Cure | 14 Min. Cure | 9 Min. Cure | 14 Min. Cure |
| A | 1.1 | 2.0 | 0% | 0% | 2.0 | 1.4 | 0% | 86% |
| B | .53 | .95 | 0% | 44% | 0.73 | 1.4 | 0% | 6% |

The embodiments of the invention in which an exclusive property or privilege is claimed are defined as follows:

1. The method which comprises coating the backing of a carpet comprising a plurality of fibers or tufts woven with a first fibrous backing with an aqueous curable adhesive composition and then applying with pressure a second fibrous backing material to said adhesive coated first fibrous backing to form a laminate, said adhesive being present in an amount sufficient to secure the ends of said fibers or tufts to said first backing material and to secure said second backing material to said first backing material, said second backing material at the time of application to said adhesive coated first backing material first having been treated with fluid $H_2O$ at a temperature and for a time sufficient to wet said secondary backing, to relax the fibers of said secondary backing, to increase the amount of fibers protruding from the cords or strands of the secondary backing and to improve the penetration of said adhesive into said secondary backing, and then heating the resulting laminate at a temperature and for a time sufficient to dry said adhesive and said secondary backing and to cure said adhesive to bind the ends of the fibers or tufts of said carpet to said primary backing and said primary backing to said secondary backing together into a unitary laminate without adversely affecting the fibers or tufts of said carpet.

2. The method according to claim 1 in which said secondary backing is square woven jute treated with wet steam at a temperature of from about 100° to 200° C.

3. The method according to claim 2 in which said adhesive contains a flexible carboxylated butadiene-styrene copolymer.

4. The method according to claim 3 in which said copolymer comprises about 50% by weight of styrene with the balance being a mixture of butadiene-1,3, methacrylic acid and itaconic acid and where said adhesive contains additionally per 200 parts by weight of latex of about 50% solids of said copolymer of from about 400 to 550 parts by weight of finely divided $CaCO_3$ and a minor amount of a polyacrylate thickener.

5. The method according to claim 4 which said laminate is heated at a temperature of from 250° to 400° F. for from about 1 to 30 minutes.

6. The method according to claim 5 where said adhesive is in the form of a froth containing from about 20 to 65% of a nonreactive gas.

7. The product produced by the method of claim 1.

8. The product according to claim 7 in which said secondary backing is square woven jute treated with wet steam at a temperature of from about 100° to 200° C.

9. The product according to claim 8 in which said adhesive contains a flexible carboxylated butadiene-styrene copolymer.

10. The product according to claim 9 in which said copolymer comprises about 50% by weight of styrene with the balance being a mixture of butadiene-1,3, methacrylic acid and itaconic acid and where said adhesive contains additionally per 200 parts by weight of latex of about 50% solids of said copolymer of from about 400 to 550 parts by weight of finely divided $CaCO_3$ and a minor amount of a polyacrylate thickener.

11. The product according to claim 10 where said laminate is heated at a temperature of from 250° to 400° F. for from about 1 to 30 minutes.

12. The product according to claim 11 where said adhesive is in the form of a froth containing from about 20 to 65% of a nonreactive gas.

* * * * *